United States Patent [19]

Bird et al.

[11] Patent Number: 4,735,588

[45] Date of Patent: Apr. 5, 1988

[54] SPRING CONTACT ELECTRICAL CONNECTOR ASSEMBLY HAVING A TWIST PROFILE

[75] Inventors: Joseph W. Bird, Abingdon, Md.; Irvin R. Triner, Stickney, Ill.

[73] Assignee: Molex Incorporated, Lisle, Ill.

[21] Appl. No.: 912,887

[22] Filed: Sep. 26, 1986

[51] Int. Cl.[4] ..... H01R 13/05

[52] U.S. Cl. ..... 439/816

[58] Field of Search ..... 339/252 P, 252 R, 256 R, 339/258 T

[56] References Cited

U.S. PATENT DOCUMENTS

| | | | |
|---|---|---|---|
| 3,222,632 | 12/1965 | Fuller | 339/256 R |
| 3,281,760 | 10/1966 | Oshima et al. | 339/256 R |
| 4,105,277 | 8/1978 | Jacobs | 339/258 T |
| 4,416,504 | 11/1983 | Sochor | 339/252 R |

*Primary Examiner*—Joseph H. McGlynn

*Attorney, Agent, or Firm*—John W. Cornell; Louis A. Hecht

[57] ABSTRACT

An electrical connector assembly including a female receptacle for receiving a mating contact member. The mating contact member is an axially elongated member formed of an electrically conductive material. The female receptacle is formed of an electrically conductive material and has an elongated, tubular body adapted to receive the mating contact member. One of the mating contact member or the tubular body of the female receptacle has a predefined, longitudinally extending rotational skew. The mating contact member has at least one resilient, elongated beam that is progressively deflected along said predefined rotational skew when inserted within the female receptacle.

1 Claim, 3 Drawing Sheets

FIG.9
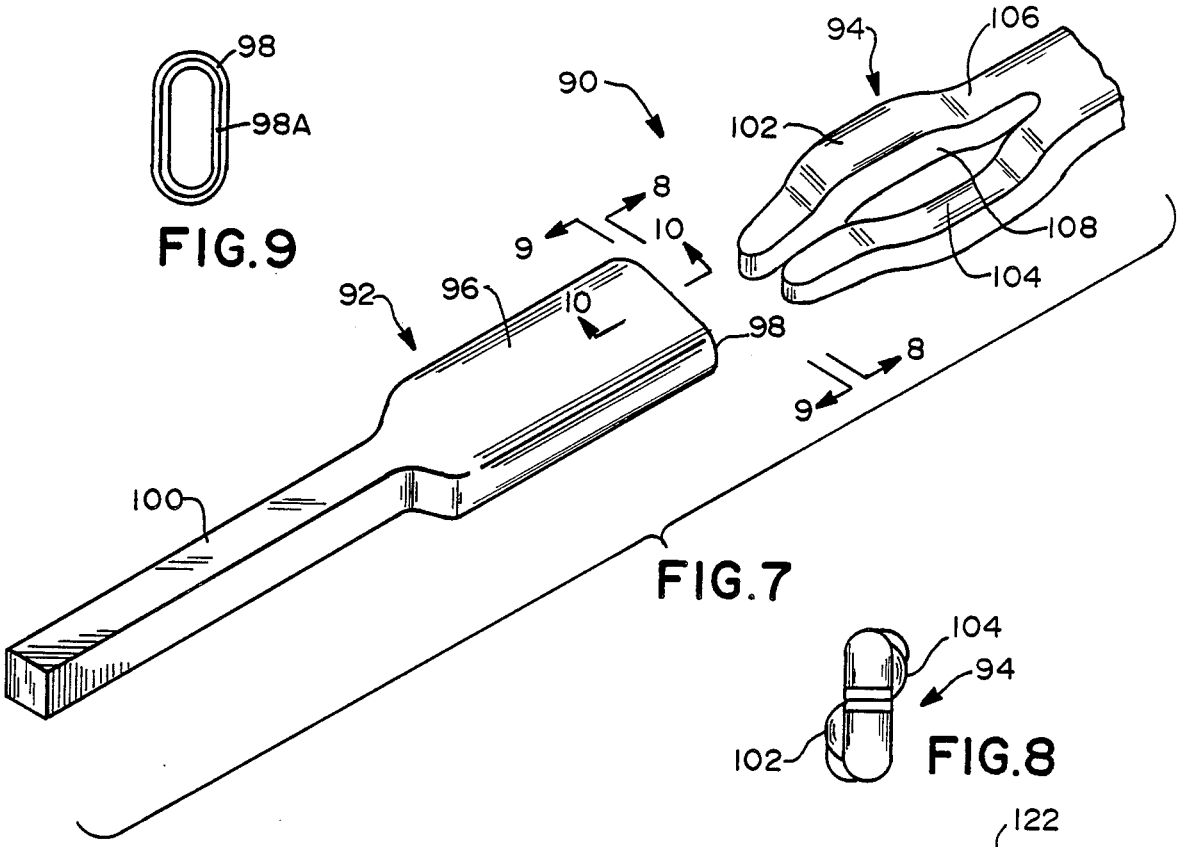
FIG.7
FIG.8
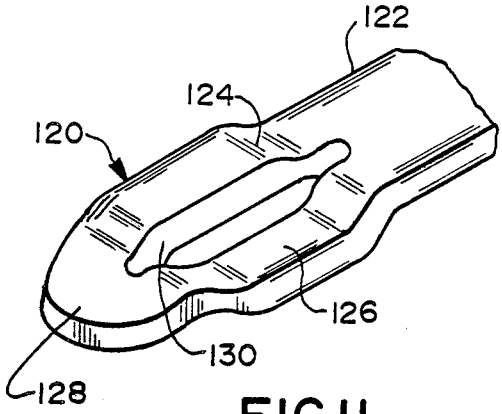
FIG.11
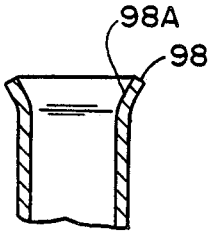
FIG.10

SPRING CONTACT ELECTRICAL CONNECTOR ASSEMBLY HAVING A TWIST PROFILE

BACKGROUND OF THE INVENTION

1. Field of the Invention

The present invention generally relates to electrical spring contact terminals and connector assemblies and more particularly, to an improved spring contact electrical connector assembly including a female receptacle for receiving a mating contact member.

2. Brief Description of the Prior Art

Various spring contact electrical connector assemblies have been provided in the past for making electrical contact between spring contact electrical terminals and other contact members such as terminal pins, circuit board edge contact pads and others. Such known spring contact terminals typically have a spring portion configured to be deflected when mated with the other contact members so that relatively high deflection forces are required to provide necessary contact forces for reliable electrical connection. Some of the resulting disadvantages are that undesirably high insertion forces are required to overcome the required deflection forces and that the insertion forces are relatively large in comparison with the withdrawal force. Another disadvantage is that an undesirably large amount of space typically is required for the various spring configurations. As consequence of these disadvantages, a desirably small center-to-center terminal spacing cannot be achieved.

SUMMARY OF THE INVENTION

Among the important objects of the invention are to provide an improved electrical connector assembly, to provide such assembly in which effective contact forces can be obtained without unduly large insertion forces; to provide such assembly in which a low ratio of insertion force to withdrawal force is achieved; and to provide such assembly overcoming disadvantages of and having smaller space requirements than assemblies used for this purpose in the past.

In brief, in accordance with the above and other objects and advantages of the invention, there is provided an electrical connector assembly including a female receptacle for receiving a mating contact member. The mating contact member is an axially elongated member formed of an electrically conductive material. The female receptacle is formed of an electrically conductive material and has an elongated, tubular body adapted to receive the mating contact member.

The electrical connector assembly of the present invention is characterized by one of the mating contact member and the tubular body of the female receptacle having a predefined, longitudinally extending rotational skew. The mating contact member has at least one resilient, elongated beam that is progressively deflected along said predefined rotational skew when inserted within the female receptacle.

BRIEF DESCRIPTION OF THE DRAWINGS

The present invention may be best understood from the following detailed description of the preferred embodiments illustrated in the accompanying drawing, wherein:

FIG. 7 is a perspective view of a different alternative embodiment of a connector assembly constructed in accordance with the present invention;

FIGS. 8, 9 and 10 are sectional views taken along the lines 8—8, 9—9, 10—10, respectively, of FIG. 7; and FIG. 11 is an alternative embodiment of a mating contact member for use with the connector assembly of FIG. 7.

DETAILED DESCRIPTION OF THE PREFERRED EMBODIMENTS

Figure 1:
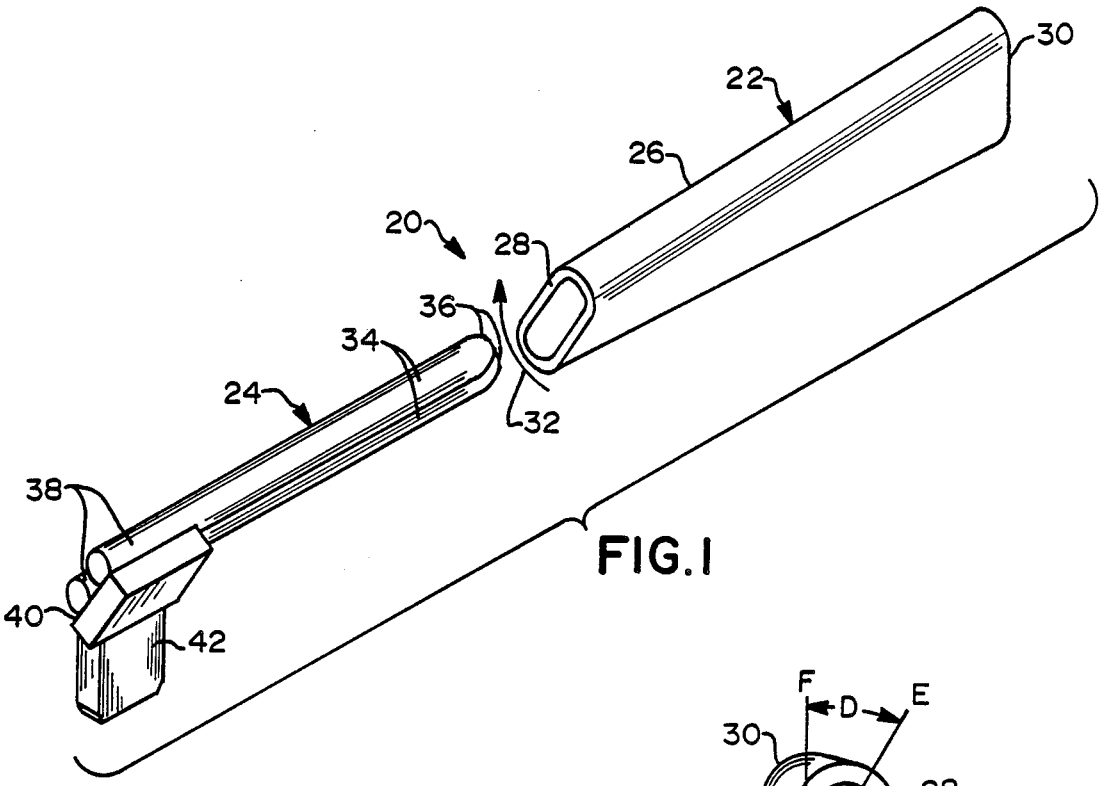
FIG. 1 is a perspective view of connector assembly constructed in accordance with the present invention.
Figure 2:
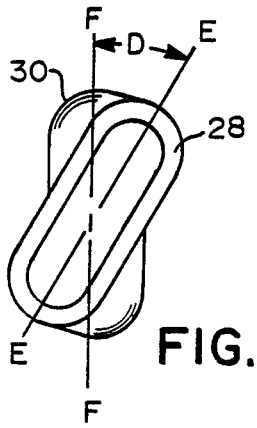
FIG. 2 is an end elevational view of a female receptacle of the connector assembly of FIG. 1.

Referring now to FIGS. 1 and 2, there is illustrated an electrical connector assembly generally designated by the reference numeral 20 and constructed in accordance with the principles of the present invention. Connector assembly 20 includes a female receptacle 22 and a mating contact member 24.

The female receptacle 22 includes an elongated, generally elliptical, tubular body 26 formed of electrically conductive material, having a forward end 28 for receiving the mating contact 24 and an opposite rear end 30 for electrical connection with another contact member (not shown).

In accordance with an important feature of the invention, the receptacle 22 has a longitudinally extending twist profile or rotational skew distributed along its length between opposite ends 28 and 30. Summation of the distributed rotational skew provides a total diversion angle shown as D in FIG. 2 from an entry axis E—E at the forward end 28 to a fully mated axis F—F at opposite end 30 for the mating contact member 24. The female receptacle 22 may be formed from straight conductive tubing that is cut to the desired length for the body 26, then firmly supported at the rear end 30 and torqued or twisted at the forward end 28 as indicated by an arrow 32 to rotationally deform the tubular body 26 to define the longitudinally extending rotational skew or twist profile for the receptacle 22.

The mating contact member 24 includes a pair of parallel, axially elongated, side-by-side beams 34 having spherical or rounded free ends 36 so configured to be smoothly received within the tubular body 26 without scoring or damaging the interior wall surfaces of the female receptacle 22. Opposite ends 38 of the parallel beams are secured to an upper, inclined surface 40 of a support member 42, such as by welding. The elongated parallel beams are formed of flexible conductive material, such as copper round wire.

When the mating contact member 24 is inserted within the female receptacle 22, the predefined longitudinal rotational skew profile of the receptacle 22 causes deflection of the resilient beams 34 to occur progressively. As a result, low insertion forces may be achieved without undue reduction in normal contact forces. A desirable wiping contact is also achieved. A line contact is obtained along the longitudinal rotational skew profile to provide good mechanical and electrical contact.

Since the resilient beams 34 are resiliently deformed below their elastic limit, when the contact member 24 is removed or demated from the receptacle 22 the beams reversely resiliently deflect to resume their original parallel longitudinally extending profile so that a low ratio of insertion to withdrawal force is provided by the contact assembly 20.

Figure 3:
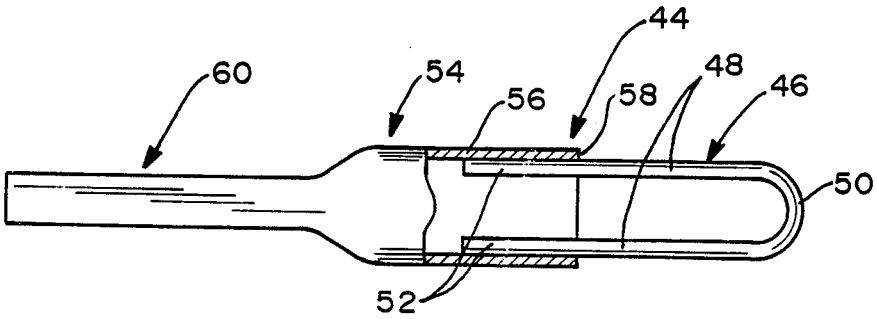
FIG. 3 is an alternative embodiment of a mating male contact member for use with the connector assembly of FIG. 1.

Referring to FIG. 3, there is shown an alternative embodiment of a mating contact member 44 that can be used with the female receptacle 22 of FIG. 1. The contact member 44 includes a single intergal member 46 defining a pair of elongated, generally parallel beams 48 with a bent, rounded free end 50. Opposite ends 52 of the resilient parallel beams 48 are secured to a support member 54. Support member 54 is formed of a tubular body 56 with a forward open end 58 for receiving the beam ends 52 and an opposite rear end 60 for engagement with another contact member (not shown). The beams ends 52 may be secured to the body 56 by welding or by crimping. The rear end 60 can be formed by compressing the tubular body 56 on all of its sides to provide the flattened rear end, as shown.

Figure 4:
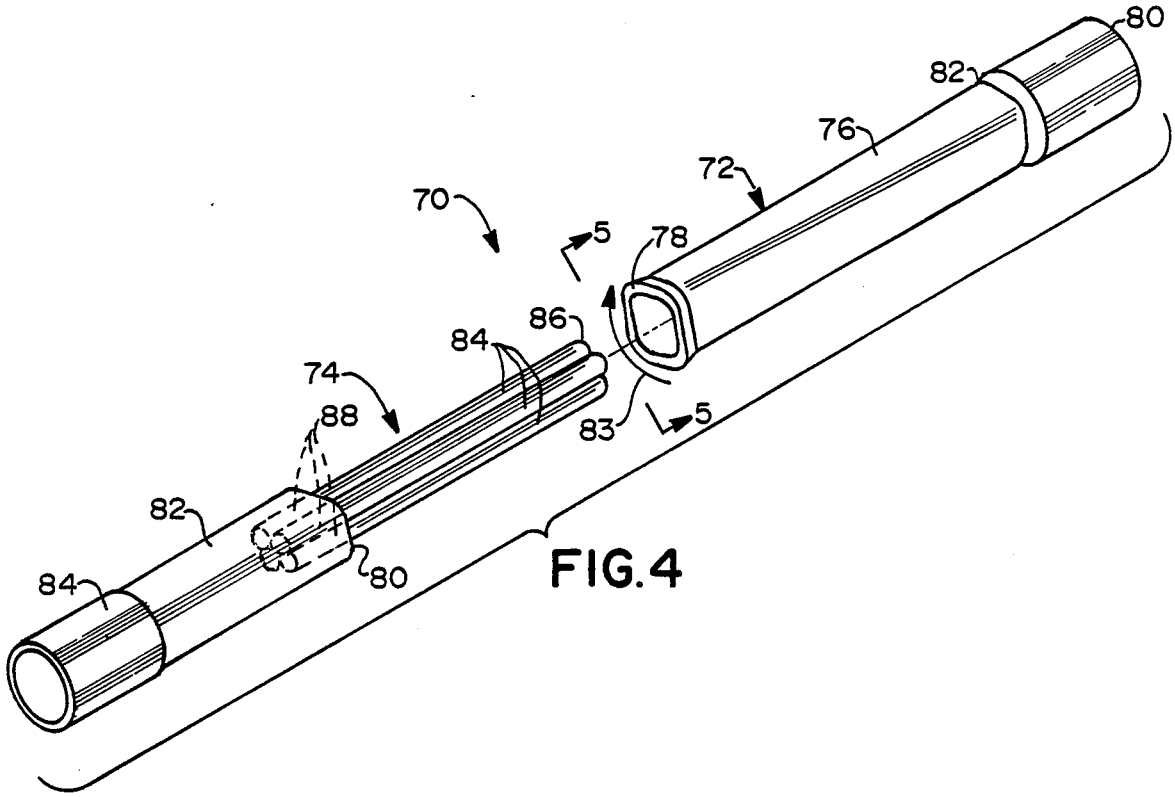
FIG. 4 is a perspective view of an alternative embodiment of the connector assembly constructed in accordance with the present invention.
Figure 6:
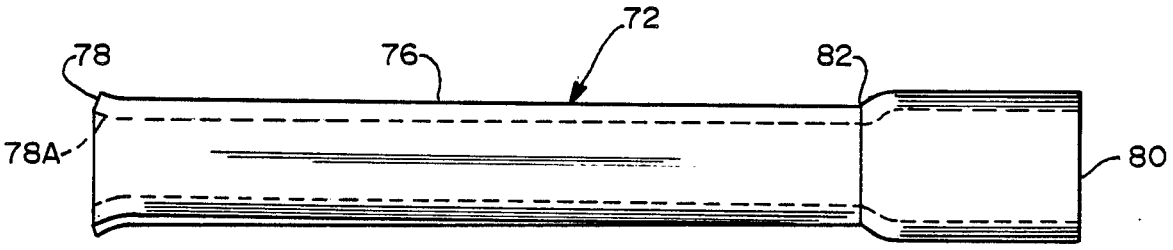
FIG. 6 is a sectional view taken along the line 6—6 of FIG. 5.
Figure 5:
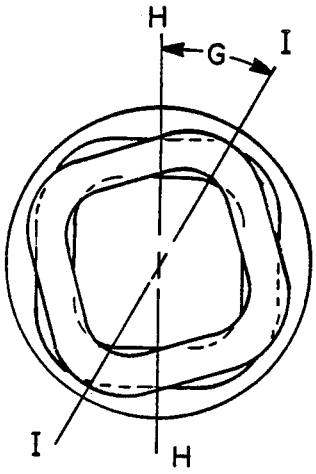
FIG. 5 is an end elevational view of a female receptacle of the connector assembly of FIG. 1.

FIGS. 4–6 show an alternative embodiment of a connector assembly according to the present invention. This connector assembly is designated as a whole by the reference numeral 70, and is constructed in accordance with the principles of the present invention. Connector assembly 70 includes a female receptacle 72 and a mating contact member 74.

The female receptacle 72 includes an elongated, generally rectangular tubular body 76 formed of electrically conductive material, having a forward end 78 for receiving the mating contact 74 and an opposite cylindrical rear end 80 for electrical connection with another contact member (not shown). As with the before-described embodiments of the present invention, the female receptacle 72 has a longitudinally extending twist profile distributed along its length between the forward end 78 and an opposite end 82 of the tubular body 76. As illustrated in FIG. 5, summation of the distributed rotational skew provides a total diversion angle shown as G in FIG. 5 from the entry axis H—H at the forward end 28 to a fully mated axis I—I at the opposite end 82 for the mating contact member 74. The longitudinally extending rotational skew for the receptacle 72 may be formed by firmly supporting the rear mating end portion 80 and twisting the forward end 78 as indicated by an arrow 83 to rotationally deform an originally straight tubular body 76.

As illustrated in FIG. 6, the forward end 78 includes an inclined or tapered lead-in 78A to insure that the mating contact member 74 is guided accurately into the receptacle body 76. The before-described embodiment likewise, advantageously includes such a tapered lead-in at the forward end 28 of the female receptacle 22.

The mating contact member 74 includes a plurality of four parallel, axially elongated beams 84 (three beams 84 are visible in FIG. 4) configured for mating with the rectangular tubular body 76. Each of the elongated beams 84 has a spherical or rounded free end 86 and an opposite end 88 (shown in dotted line) secured within a forward open end 80 of the support member 82. A similar tubular body as used for the receptacle 72 (except without the rotational skew) may be utilized for the support member 82. The beam ends 88 may be secured within the support member 82 by welding or crimping. Support member 82 includes an enlarged, cylindrical rear end 84 for mating engagement with another contact member (not shown).

Referring now to FIGS. 7–10, there is illustrated a different alternative electrical connector assembly generally designated by the reference character 90 and constructed in accordance with the principles of the present invention. Connector assembly 90 includes a female receptacle 92 and a mating contact member 94.

The female receptacle 92 includes an elongated, generally elliptical, tubular body 96 formed of an electrically conductive material, having a forward end 98 for receiving the mating contact member 94 and an opposite, flattened tail end 100 for electrical connection to another contact member (not shown). As shown in FIG. 10, the forward end 98 includes a tapered lead-in portion 98A. The female receptacle 92 may be formed from straight conductive tubing that is cut to the desired length for the body 96 and tail portion 100. The tail portion 100 can be formed as shown by applying a compressive force on all of the sides to flatten the tubular member. As shown in FIG. 9, the tubular body 96 axially extends in a straight line or single plane.

In accordance with the principles of the present invention, the mating contact member 94 is provided with a longitudinally extending skew distributed generally along its length. The mating contact member 94 includes a pair of beams 102 and 104. An integral member 106, such as conductive flat wire can be used to form the contact member 94. The integral member 106 may be formed through a die with a central open slot or slit 108 sheared or pierced between the opposite beams 102 and 104. The bifurcated beams 102 and 104 can be coined to extend in opposite directions, as shown in FIGS. 7 and 8 with beam 102 extending up and beam 104 extending down to define a longitudinally extending skew profile somewhat helical in nature.

When the mating contact member 94 is inserted within the female receptacle 92, the resilient beams 102 and 104 are progressively deflected along the predefined longitudinal skew profile of the mating contact member 94. As with the before-described embodiments of connector assemblies 20 and 70, the connector assembly 90 enables low insertion forces without undue reduction in normal contact forces while providing a line contact along the longitudinal skew profile of the mating contact member 94 to provide good mechanical and electrical contact. In addition, the resilient beams 102 and 104 reversely deflect to resume their longitudinal extending skew profile when removed or demated from the receptacle 92 so that a low ratio of insertion to withdrawal force is provided by the contact assembly 90.

Referring now to FIG. 11, here is shown an alternative embodiment of a mating contact member generally designated by the reference numeral 120 for use with the connector assembly 90 of FIG. 7. The mating contact member 120 includes an integral member 122 such as conductive flat wire defining a pair of elongated beams 124 and 126 with a common rounded free end 128. A slot or groove 130 is formed between the opposite beams 124 and 126. The beams 124 and 126 are formed to define a longitudinally extending skew profile, such as by coining the beams 124 and 126 to extend in opposite directions.

A series of either mating contact members 94 or 120 advantageously may be simply fabricated by progressive stamping and coining operations from a single, one-piece, continuous strip of metal to provide an extremely small center-to-center spacing of the members 94 or 120 along the sheet metal stock.

Although the present invention has been described in connection with details of the preferred embodiment, many alterations and modifications may be made without departing from the invention. It should be understood that connector assemblies 20, 70 and 90 constructed in accordance with the principles of the present invention may be provided with rigid mating contact members and resilient tubular receptacles adapted for resilient deflection. Accordingly, it is intended that all such alterations and modifications be considered within the spirit and scope of the invention as defined in the appended claims.

We claim:

1. An electrical contact assembly including a female receptacle for receiving a mating contact member, said mating contact member being an axially elongated member formed of a resiliently deflectable electrically conductive material which, in an unmated state, longitudinally extends generally in a single plane including a plurality of parallel beams, said female receptacle being formed of an electrically conductive material and having an elongated elliptical tubular body the interior surfaces of which are adapted to slidable engage said mating contact member, the improvement comprising:

said female receptacle including a forward mating end, an opposed rear end and a longitudinally extending rotational screw distributed along its length between said ends, such that the interior surfaces of the receptacle define a generally helical interior for slidable receiving and gradually deflecting said mating contact member, whereby normal contact forces are developed by insertion of the mating contact member into the female receptacle causing gradual resilient deflection of the mating contact member from a planar unmated configuration to a non-planar mated configuration wherein it assumes the generally helical configuration of the interior of the female receptacle.

* * * * *